US007614105B1

(12) United States Patent
Jackson et al.

(10) Patent No.: US 7,614,105 B1
(45) Date of Patent: Nov. 10, 2009

(54) MATTRESS FOR PRONE AND SUPINE SLEEPING AND ASSOCIATED METHOD

(76) Inventors: Jermaine Jackson, 923 Pinecone Dr., Corona, CA (US) 92880; Aisha Jackson, 923 Pinecone Dr., Corona, CA (US) 92880

( * ) Notice: Subject to any disclaimer, the term of this patent is extended or adjusted under 35 U.S.C. 154(b) by 0 days.

(21) Appl. No.: 12/221,670

(22) Filed: Aug. 5, 2008

Related U.S. Application Data

(60) Provisional application No. 60/963,402, filed on Aug. 6, 2007.

(51) Int. Cl.
*A47C 21/04* (2006.01)
*A47G 9/00* (2006.01)

(52) U.S. Cl. ..... 5/725; 5/640

(58) Field of Classification Search ..... 5/725, 5/638, 690, 636, 640
See application file for complete search history.

(56) References Cited

U.S. PATENT DOCUMENTS 2,810,920 A * 10/1957 Carruth ..... 5/725
3,362,031 A 1/1968 Lemly
4,536,906 A 8/1985 Varndell
5,426,798 A 6/1995 Guarino
5,697,113 A * 12/1997 Shatz et al. ..... 5/655
5,893,183 A * 4/1999 Bechtold, Jr. ..... 5/632
6,148,460 A 11/2000 Fried et al.
6,604,253 B2 * 8/2003 Babbini ..... 5/733

* cited by examiner

*Primary Examiner*—Alexander Grosz

(57) ABSTRACT

A multi-purpose bed for permitting a user to comfortably lay face-down during extended time periods may include a mattress with a linear passageway formed between top and bottom surfaces. The passageway may also extend from the center of the mattress to opposed longitudinal sides thereof. A plurality of openings, connected to the passageway, may be formed in the top surface of the mattress. A plurality of pillows may be removably attached to the top of the mattress and positioned along partial perimeters of the openings. A plurality of panels may be situated beneath the openings. A mechanism for independently adapting each of the panels between open and closed positions for permitting and prohibiting free flow of the ambient air through a corresponding one of the openings and the passageway may also be included.

20 Claims, 3 Drawing Sheets

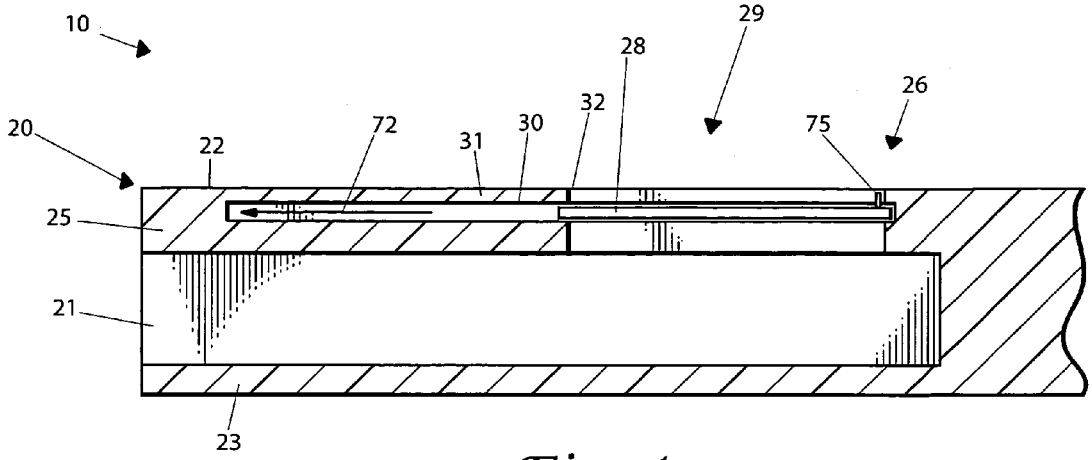
Fig. 4
Fig. 5
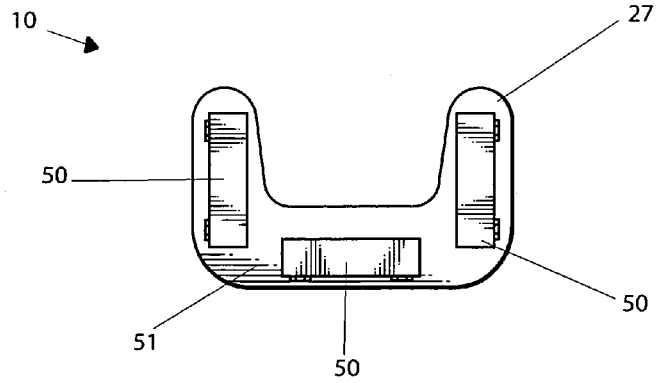
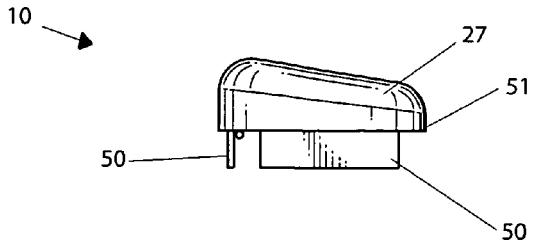
Fig. 6

MATTRESS FOR PRONE AND SUPINE SLEEPING AND ASSOCIATED METHOD

CROSS REFERENCE TO RELATED APPLICATIONS

This application claims the benefit of U.S. Provisional Application No. 60/963,402, filed Aug. 6, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to beds and, more particularly, to a multi-purpose bed for permitting a user to comfortably lay face-down during extended time periods.

2. Prior Art

Most people spend about one-third of their lives sleeping or resting. It is widely accepted in the medical field that proper rest is needed in order to sustain a healthy lifestyle. Poor bedding support, improper sleeping positions, particularly misalignment of the neck during sleeping can lead to a wide variety of physical and, consequently, psychological ailments. Cervical (neck) distortion aggravates, directly and indirectly, vertebral position, muscles and nerves dependent upon those positions. There is also a recognized correlation between cervical distortion and lumbar (low back) function. Such distortion does not necessarily correct itself and can lead to subluxations (vertebral misalignments), nerve interference, muscular aches and pains. The ailments can cause a person to be less functional, less productive, less restful and irritable. These ailments can have a high cost to society in lost work days, medical visits, ancillary treatments and collectively contribute to the present strain on the health care systems of society.

With a conventional mattress, people desiring to sleep in a prone, i.e. face down, position are required to turn their heads in order to breathe. Prolonged fixation of the neck in this position creates muscular, vascular and spinal stresses which can lead to pain not only in the neck but also in the fingers, head, shoulders and arms. Lower back problems caused or exacerbated may require expensive professional treatment. In light of the desire for many people to sleep in the prone position and the recognized disadvantages of having people sleep on their stomachs while turning their heads to breathe, mattresses have been previously proposed which provide openings near the superior end of a mattress to accommodate a person's head while allowing the free flow of needed air.

The prior attempts to design a mattress that comfortably supports a person sleeping in a prone position have had serious shortcomings. For example, some prior designs had rectangular openings which did not comfortably accommodate different head sizes and face shape differences. Such openings also did not provide for variations in facial-mattress contact by the person sleeping during a resting period. Other such prior mattresses proposed for prone sleeping positions, were provided with circular or oval openings which were also limited to faces and heads having certain sizes.

U.S. Pat. No. 3,362,031 to Lemly discloses a two piece mattress face rest adapted to be inserted within an opening in a mattress wherein the top and bottom pieces are joined to provide a sleeve to fit the mattress opening. Both the top and bottom pieces have peripheral flanges which lie flat on the top and bottom of the mattress. The two pieces snugly wedge within the opening, mating at their end peripheries. Unfortunately, this prior art reference does not provide a plurality of pillows removably attached to the top surface of the mattress and positioned about partial perimeters of the openings to align the user's face with the opening.

U.S. Pat. No. 4,536,906 to Varndell discloses a mattress for small children with a removable foam insert that fits in an aperture cut in the head portion of a foam mattress body. The insert has a plurality of perforations extending from its top face to its bottom face which reduce the risk of suffocation. The perforations are grouped towards the head of the mattress for optimum positioning beneath the child's head. To ensure that a replacement insert, when the former insert is soiled and requires washing, is fitted in the correct orientation, each insert has a key portion projecting from one edge for interlocking with a correspondingly shaped recess in a side wall of the aperture. Unfortunately, this prior art reference does not provide a means for partitioning the passageway into a plurality of segments and thereby prohibiting free flow of the ambient air, air-borne fluids, and debris through an entire longitudinal length of the passageway.

U.S. Pat. No. 5,426,798 to Guarino discloses a resting support, for example, a mattress, comprising an interior slot designed to support a person resting in the prone position. One embodiment comprises a slot having a first sidewall which extends at an angle downwardly from the substantially planar resting surface and a second sidewall which extends from a lower portion of the first sidewall, preferably at an angle which is steeper than the angle of the first sidewall. Also disclosed is a box spring having a corresponding, and preferably, larger opening. A removable, supplemental facial support is also disclosed. Unfortunately, this prior art reference does not provide a plurality of pillows to support the user's head and would likely result in uncomfortable support of the user's face.

Accordingly, a need remains for an apparatus to overcome the above stated shortcomings. The present invention satisfies such a need by providing a multi-purpose bed that is convenient and easy to use, is durable and versatile in its applications, and provides users with an ergonomically designed mattress which enables them to comfortably and safely lay face-down during extended time periods.

BRIEF SUMMARY OF THE INVENTION

In view of the foregoing background, it is therefore an object of the present invention to provide an apparatus for permitting a user to comfortably lay face-down during extended time periods. These and other objects, features, and advantages of the invention are provided by a mattress for prone and supine sleeping and associated method.

A multi-purpose bed for permitting a user to comfortably lay face-down during extended time periods may include a mattress preferably having a linear passageway formed between top and bottom surfaces thereof. Such a passageway may extend towards a center of the mattress and may be disposed between opposed longitudinal sides of the mattress. This allows ambient air preferably to be permitted to ingress and egress between the bottom and top surfaces of the mattress. The mattress further may have a plurality of openings formed through the top surface thereof. The plurality of openings allows for multiple users to take advantage of the benefits of the air flow within the passageway. Each of the openings may be suitably sized and shaped for receiving a user face thereat while the user is laying face-down on the top surface of the mattress. The user's placement of their face within the opening allows for proper sinus drainage and reduced snoring, along with correct alignment of the neck and spinal cord while sleeping face down.

Additionally, a plurality of pillows may be removably attached to the top surface of the mattress and positioned along partial perimeters of the openings respectively such that the user face may be supported adjacent to the openings while the user is laying face-down on the mattress. The pillows work to stabilize the user's head in a comfortable manner to assist the user to obtain a restful night of sleep. Further, a plurality of panels may be adjustably situated beneath the openings respectively. A mechanism for independently adapting each of the panels between open and closed positions for permitting and prohibiting free flow of the ambient air through a corresponding one of the openings and the passageway respectively may also be included. This allows a user to selectively take advantage of the air flow in the passageway or to sleep without it.

Each of the panels are preferably displaced along corresponding travel paths extending subjacent to the openings and may be defined between the top and bottom surfaces of the mattress respectively for preventing air-borne fluids and debris from passing through the openings and the passageway respectively. In this manner, two users will not be forced to breathe each other's expelled air, preventing the contraction of air borne viruses or unpleasant odors.

The independent panel adapting mechanism may include a plurality of linear tracks formed along an interior wall of the mattress and spanning beneath the openings respectively. Such linear tracks may have a longitudinal length greater than a longitudinal length of the openings. The linear tracks preferably outwardly extend away from a medial edge of the openings and terminate adjacent to the longitudinal sides of the mattress respectively. Further, at least one portion of the panels may be slidably interfitted within the linear tracks such that the panels remain disposed above the passageway and subjacent to the top surface of the mattress while preferably being linearly displaced along the corresponding travel paths respectively.

Additionally, the corresponding travel paths may be oriented parallel to a longitudinal length of the passageway as well as the top and bottom surfaces of the mattress respectively. Also, the corresponding travel paths preferably are mutually exclusive and non-overlapping. In addition, the corresponding travel paths may be linear and defined adjacent to the passageway such that the panels do not penetrate the passageway when displaced between the open and closed positions respectively. This allows one user to open or close the panel without affecting the air flow to the other user.

The independent panel adapting mechanism may include a plurality of guide arms extending away from an interior wall of the mattress and spanning beneath the openings respectively. Such guide arms may be oriented along first and second linear rows facing opposite sides of the interior wall. The guide arms may further have a longitudinal length registered perpendicular to the longitudinal length of the passageway and may maintain a fixed spatial relationship from an adjacent one of the guide arms within the first and second rows respectively. Additionally, selected ones of the spatial relationships may be equal to a first linear distance and other ones of the spatial distances may be equal to a second linear distance.

Further, a plurality of wheels may be connected to opposed corners of the panels respectively. Such wheels may have a fixed diameter that is greater than the first linear distance and less than the second linear distance respectively. Also, the corresponding travel paths of the panels may be arcuate and defined about oppositely situated fulcrum pivot axes defined at opposed ends of the panels respectively. Such fulcrum pivot axes may be oriented perpendicular to the longitudinal length of the passageway respectively. Each of the fulcrum pivot axes may be substantially aligned with the corresponding edges of the openings respectively such that the panels pivot downward and upward within the passageway respectively.

The first and second ones of the wheels may be respectively supported on top of a first pair of the guide arms at the first row and a second pair of the guide arms at the second row respectively. The first and second guide arm pairs preferably maintain the first linear distance therebetween respectively. Additionally, third and fourth ones of the wheels may be respectively passed between a third pair of the guide arms at the first row and a fourth pair of the guide arms at the second row respectively. Further, the third and fourth pairs of the guide arms may maintain the second linear distance therebetween respectively.

The multi-purpose bed may also include each of the panels preferably being selectively pivoted about first and second arcuate paths and thereby independently articulated between a horizontally rested position and a vertically rested position traversing the longitudinal length of the passageway respectively. In addition, the multi-purpose bed may include the passageway preferably being partitioned when at least one of the panels is pivoted to the vertically rested position respectively. This prohibits the flow of air from one side of the passageway to the next, allowing two users to breathe into the passageway without affecting each other or breathing each other's exhaled particles. A handle may be included on a bottom side of each of the panels. Such a handle may only be accessible through the openings when the openings are exposed. The handle is vital so that the user may grasp the handle to reposition the panels between a horizontal and vertical position.

The independent panel adapting mechanism further may include first and second linear channels formed along oppositely facing medial and lateral ends of the panels respectively. Additionally, a plurality of juxtaposed notches may be formed within the inner wall of the mattress and situated subjacent to the openings respectively. A first pair of spring-actuated levers may pass through the first linear channel in such a manner that axially opposed ends of the first pair of levers may be removably interfitted into corresponding ones of the notches respectively.

Further, a second pair of spring-actuated levers may pass through the second linear channel in such a manner that axially opposed ends of the second pair of levers preferably are removably interfitted into corresponding ones of the notches respectively. First and second access ports may also be formed at top surfaces of the panels respectively. In addition, the axially opposed ends of the first and second lever pairs may be resiliently displaced along first and second linear travels paths when proximal ends of the first and second lever pairs are resiliently displaced along third and fourth linear paths respectively. This operates such that the panels preferably are caused to selectively pivot along the corresponding travel paths as desired by the user. Also, the first and third linear travel paths may be situated at a first lateral end of the panels while the second and fourth travel paths may be situated at a second lateral end of the panels respectively so that the panels are selectively articulated along either of the first and second lateral ends respectively.

The multi-purpose bed may further include each of the pillows being U-shaped. The shape of the pillow advantageously fits the user's face to comfortably position the user's head to allow for alignment of the body and easier breathing during sleep. Each pillow may also include a plurality of legs pivotally connected to a bottom surface thereof. Such legs may be selectively biased between folded and unfolded positions and thereby elevate the bottom surface of the pillows away from the top surface of the mattress for providing user comfort. A user selectively positions the pillows at a height appropriately set for their neck alignment and body position to prevent the twisting of the vertebrae that occurs when a person normally sleeps in the prone position.

Each of the pillows may further include a plurality of telescopically adjusted anchor pegs removably nested within corresponding orifices formed in the top surface of the mattress. Such anchor pegs may maintain the pillows at a substantially stable position during extended time periods.

It is an additional intent of the present invention to provide a method for permitting a user to comfortably lay face-down during extended time periods. Such a method may include the chronological steps of first providing a mattress preferably having a linear passageway formed between top and bottom surfaces thereof. The passageway may extend towards a center of the mattress and may be disposed between opposed longitudinal sides of the mattress such that ambient air is permitted to ingress and egress between the bottom and top surfaces of the mattress. The passageway's extension across the mattress allows for multiple openings to permit air flow during placement of the bed against a wall if needed. The mattress further may have a plurality of openings formed through the top surface thereof to accommodate multiple users at the same time. Each of the openings may be suitably sized and shaped for receiving a user face thereat while the user is laying face-down on the top surface of the mattress.

A second step of the method may include providing and removably attaching a plurality of pillows to the top surface of the mattress by positioning the pillows along partial perimeters of the openings respectively. This operates such that the user face is supported adjacent to the openings while the user is laying face-down on the mattress. A third step may include providing and adjustably situating a plurality of panels beneath the openings respectively.

Fourthly, the method may include permitting and prohibiting free flow of the ambient air through a corresponding one of the openings and the passageway by independently adapting each of the panels between open and closed positions respectively. Finally, a fifth step may include preventing airborne fluids and debris from passing through the openings and the passageway by displacing each of the panels along corresponding travel paths extending subjacent to the openings and defined between the top and bottom surfaces of the mattress respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 4 is a cross sectional view of the multi-purpose bed showing the independent panel adapting mechanism with the panel sliding along the track, taken along line 4-4, as seen in FIG. 3;

FIG. 5 is a bottom plan view of the pillow showing the legs in a folded position;

FIG. 6 is a side elevational view of the pillow showing the legs in an unfolded position;

DETAILED DESCRIPTION OF THE INVENTION

Figure 1:
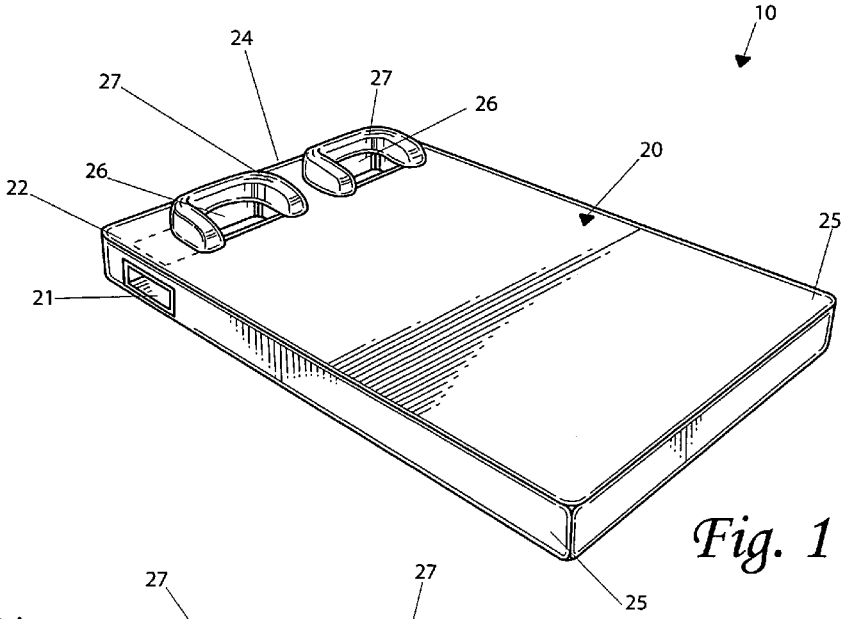
FIG. 1 is a perspective view showing a multi-purpose bed, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-8 by the reference numeral 10 and is intended to provide a multi-purpose bed. It should be understood that the apparatus 10 may be used to permit a user to comfortably lay in many different positions and should not be limited in use to the applications mentioned herein. For example, the multi-purpose bed may be employed as a massage table as well as a bed for sleeping and relaxing purposes.

Referring initially to FIGS. 1-6, a multi-purpose bed 10 for permitting a user to comfortably lay face-down during extended time periods may include a mattress 20 preferably having a linear passageway 21 formed between top 22 and bottom 23 surfaces thereof. Such a passageway 21 may extend towards a center 24 of the mattress 20 and may be disposed between opposed longitudinal sides 25 of the mattress. This preferably allows ambient air to be permitted to ingress and egress between the bottom 23 and top 22 surfaces of the mattress 20. The mattress 20 further may have a plurality of openings 26 formed through the top 22 surface thereof. Such a plurality of openings 26 preferably allows for multiple users to take advantage of the benefits of the air flow within the passageway 21.

Each of the openings 26 may also be suitably sized and shaped for receiving a user face thereat while the user is positioned face-down on the top surface 22 of the mattress 20. The user's placement of their face within the opening 26 allows for proper sinus drainage and reduced snoring, along with correct alignment of the neck and spinal cord while sleeping face down.

Figure 2:
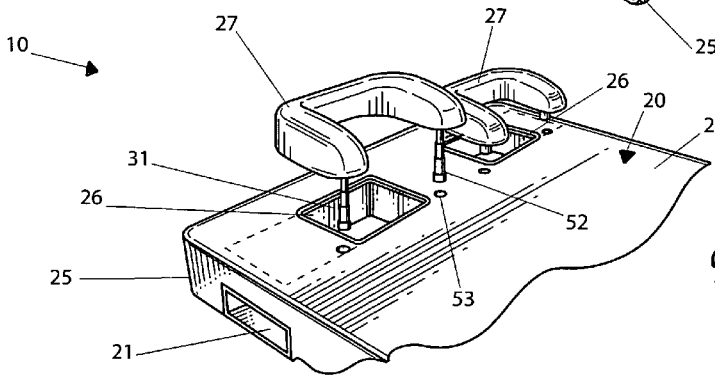
FIG. 2 is an enlarged perspective view of the of the multi-purpose bed showing the pillows and the telescopically adjusted anchor pegs removed from corresponding orifices formed in the top surface of the mattress.
Figure 3:
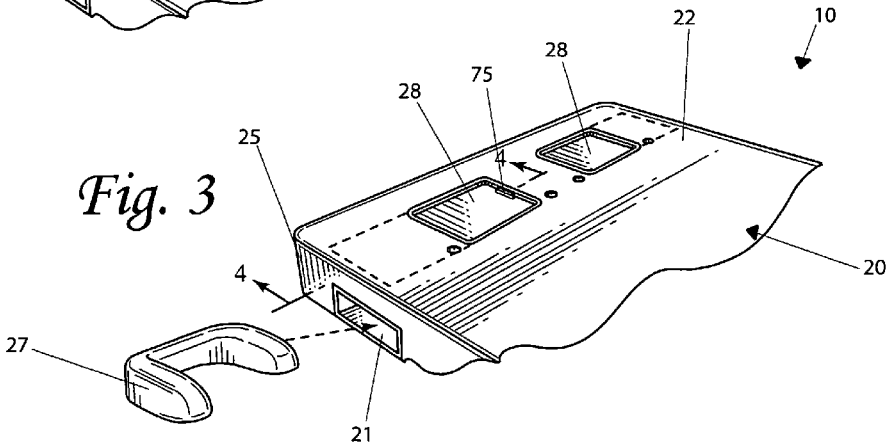
FIG. 3 is an enlarged perspective view of the multi-purpose bed with the panels in a closed position and showing the pillows removed from the top surface of the mattress to be stored in the air passageway.

Referring to FIGS. 1-4, additionally, a plurality of pillows 27 may be removably attached to the top 22 surface of the mattress 20 and positioned along partial perimeters of the openings 26 respectively such that the user face may be supported adjacent to the openings 26 while the user is laying face-down on the mattress 20. The pillows 27 stabilize the user's head in a comfortable manner to assist the user in obtaining a restful night of sleep. The pillow 27 also protects the user from neck or spine injuries that may result from improper sleeping positioning. When not in use, the pillow 27 may be conveniently stored in the air passageway as seen in FIG. 3. This saves the user time and energy.

For example, if the user who is sleeping face down and employing the pillow 27 suddenly desires to sleep face up. The user will simply remove the pillow 27 from the top surface 22 of the mattress 20 and stow the pillow 27 in the passageway 21. Later, the user may quickly retrieve the pillow 27 from storage when so desired. This is especially beneficial when the user wishes to change positions in the middle of a resting period because searching for the pillow 27 may interfere with the user's rest.

Referring again to FIGS. 1-4, a plurality of panels 28 may be adjustably situated beneath the openings 26 respectively. A mechanism 29 for independently adapting each of the panels 28 between open and closed positions for permitting and prohibiting free flow of the ambient air through a corresponding one of the openings 26 and the passageway 21 respectively may also be included. The user may adapt the panel 28 to an open position and employ the opening 26 when sleeping face down or the user may adapt the panel 28 to a closed position. In the latter case, the closed panel 28 provides the necessary head support for the user sleeping face up. This further allows the user to selectively take advantage of the air flow in the passageway 21 or to sleep without it.

It should be noted that reference numeral 26 may refer interchangeably to both the plurality of openings and a single opening. Likewise, reference numeral 28 may refer to both the plurality of panels and a single panel. Additionally, reference numeral 27 may refer to both the plurality of pillows and a single pillow. For the present invention, the attributes of a single opening 26 or a single panel 28 may apply to a plurality of openings and panels respectively. For example, the description the opening and panel situated on one side of the mattress applies to the opening and panel situated on the other side of the mattress.

Referring to FIGS. 1-4, each of the panels 28 preferably are displaced along corresponding travel paths 72 extending subjacent to the openings 26 and may be defined between the top 22 and bottom 23 surfaces of the mattress respectively for preventing air-borne fluids and debris from passing through the openings 26 and the passageway 21 respectively. In this manner, two users will not be forced to breathe expelled air from one another, preventing the contraction of air borne viruses or unpleasant odors. Additionally, fresh ambient air from the passageway 21 prevents the user from inhaling harmful carbon dioxide from another user and incurring injuries.

Referring to FIGS. 1-4, in a preferred embodiment of the present invention, the independent panel adapting mechanism 29 may include a plurality of linear tracks 30 formed along an interior wall 31 of the mattress 20 and spanning beneath the openings 26 respectively. Such linear tracks 30 may have a longitudinal length greater than a longitudinal length of the openings 26. The linear tracks 30 preferably outwardly extend away from a medial edge 32 of the openings 26 and terminate adjacent to the longitudinal sides 25 of the mattress 20 respectively. Further, at least one portion of the panels 28 may be slidably interfitted within the linear tracks 30 such that the panels 28 remain disposed above the passageway 21 and subjacent to the top surface 22 of the mattress 20 while preferably being linearly displaced along the corresponding travel paths 72 respectively. The panels may also feature an indented handle 75 which is important such that the user may grasp the handle 75 when adapting the panel 28 to an open or closed position.

Referring again to FIGS. 1-4, the corresponding travel paths 72 may be effectively oriented parallel to a longitudinal length of the passageway 21 as well as the top 22 and bottom 23 surfaces of the mattress 20 respectively. Also, the corresponding travel paths 72 preferably are mutually exclusive and non-overlapping. In addition, the corresponding travel paths 72 may be linear and defined adjacent to the passageway 21 such that the panels 28 do not penetrate the passageway 21 when displaced between the open and closed positions respectively. This allows one user to open or close the panel 28 without affecting the air flow to the other user. When the user adapts the opening 26 to an open position, the panel 28 is automatically stored between the top 22 surface of the mattress 20 and the passageway 21.

Figure 7:
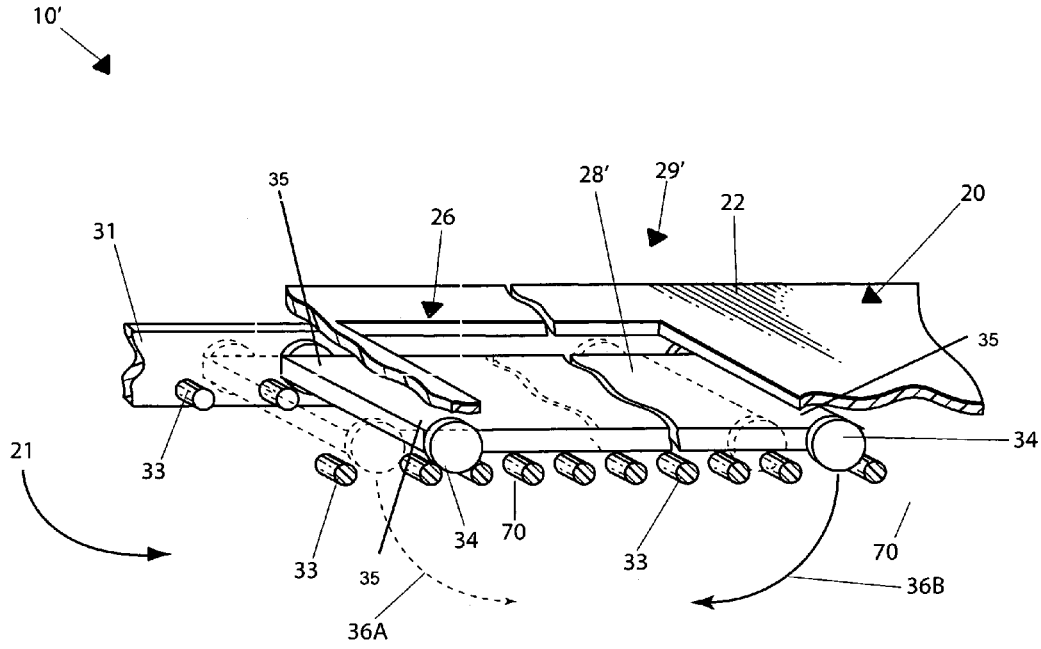
FIG. 7 is a perspective view of the independent panel adapting mechanism showing the support arms affixed to the inside wall of the opening, in accordance with an alternate embodiment of the present invention.

Referring to FIG. 7, in an alternate embodiment of multipurpose bed 10', the independent panel adapting mechanism 29' may include a plurality of guide arms 33 extending away from an interior wall 31 of the mattress 20 and spanning beneath the openings 26 respectively. Such guide arms 33 may be oriented along first and second linear rows facing opposite sides of the interior wall 31. The guide arms 33 may further have a longitudinal length registered perpendicular to the longitudinal length of the passageway 21 and may maintain a fixed spatial relationship from an adjacent one of the guide arms 33 within the first and second rows respectively.

Referring again to FIG. 7, selected ones of the spatial relationships may be equal to a first linear distance and other ones of the spatial distances may be equal to a second linear distance. Further, a plurality of wheels 34 may be connected to opposed corners 35 of the panels 28' respectively. Such wheels 34 may have a fixed diameter that is greater than the first linear distance and less than the second linear distance respectively. Also, the corresponding travel paths 36 of the panels 28' may be arcuate and defined about oppositely situated fulcrum pivot axes 70 defined at opposed ends of the panels respectively. Such fulcrum pivot axes 70 may be oriented perpendicular to the longitudinal length of the passageway 21 respectively. Each of the fulcrum pivot axes 70 may be substantially aligned with the corresponding edges of the openings respectively such that the panels 28' pivot downward and upward within the passageway 21 respectively. The combined elements of the guide arms 33 and the wheels 34 provide an alternative method for pivoting the panel 28' between horizontal and vertical orientation.

Referring again to FIG. 7, the first and second ones of the wheels 34 may be respectively supported on top of a first pair of the guide arms 33 at the first row and a second pair of the guide arms at the second row respectively. The first and second guide arm 33 pairs preferably maintain the first linear distance therebetween respectively. Additionally, third and fourth ones of the wheels may be respectively passed between a third pair of the guide arms at the first row and a fourth pair of the guide arms at the second row respectively. Further, the third and fourth pairs of the guide arms may maintain the second linear distance therebetween respectively. For example, the wide spaced guide arms 33 allow the wheels 34 to pass through while the close spaced guide arms 33 support the wheels 34. In this manner, the user selects one end of the panel 28' to act as the fulcrum axis 70 by positioning the wheels 34 on the opposite end of the panel 28' over a pair of wide spaced guide arms 33 to thereby pass through. This enables the user to selectively pivot the panel 28' toward either side 25 of the mattress.

Referring again to FIG. 7, the alternative embodiment of the multi-purpose bed 10' may also include each of the panels 28' preferably being selectively pivoted about first 36A and second 36B arcuate paths and thereby independently articulated between a horizontally rested position and a vertically rested position traversing the longitudinal length of the passageway 21 respectively. The passageway 21 may preferably be partitioned when at least one of the panels 28' is pivoted to the vertically rested position respectively. This prohibits the flow of air from one side of the passageway 21 to the next, allowing two users to breathe into the passageway 21 without affecting each other or breathing each other's exhaled particles.

In both the preferred embodiment of the apparatus 10 and the alternate embodiment of the apparatus 10', a handle may be included on a bottom side of each of the panels 28, 28'. Such a handle is not shown but understood by one skilled in the art to be any type of protrusion which the user may grasp. The handle may only be accessible through the openings 26 when the panels 28 are open and the openings 26 are exposed. The handle is elective and not an essential component of the present invention.

Figure 8:
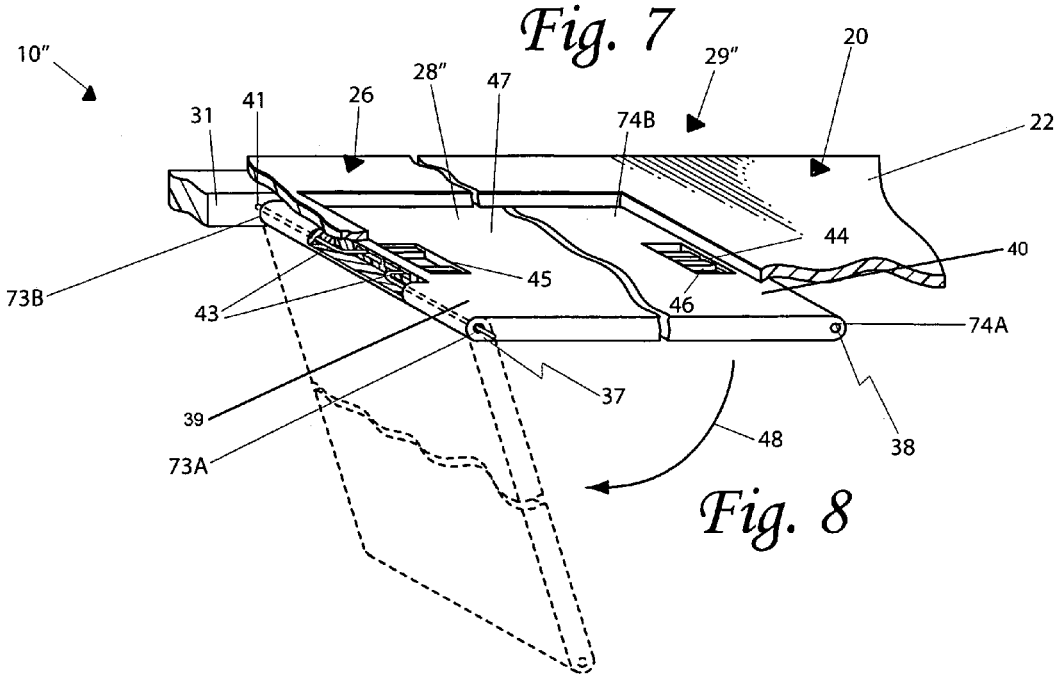
FIG. 8 is a perspective view of the independent panel adapting mechanism showing the first and second spring actuated levers, in accordance with an additional embodiment of the present invention.

Referring for FIG. 8, in yet another embodiment of the apparatus 10", the independent panel adapting mechanism 29" further may include first 37 and second 38 linear channels formed along oppositely facing medial 39 and lateral 40 ends of the panels 28" respectively. Additionally, a plurality of juxtaposed notches 41 may be formed within the inner wall 31 of the mattress 20 and situated subjacent to the openings 26 respectively. It should be noted that the reference numeral 41 refers to both the plurality of notches and a single notch, although only a single notch 41 is pictured in the figure. A first pair of spring-actuated levers 43 may pass through the first linear channel 37 in such a manner that axially opposed ends 73A, 73B of the first pair of levers 43 may be removably interfitted into corresponding ones of the notches 41 respectively.

Further, a second pair of spring-actuated levers 44 may pass through the second linear channel 38 in such a manner that axially opposed ends 74A, 74B of the second pair of levers 44 preferably are removably interfitted into corresponding ones of the notches 41 respectively.

Referring again to FIG. 8, in the additional embodiment of the apparatus 10", first 45 and second 46 access ports may be formed at a top surface 47 of the panel 28" respectively. This is important so that the user may engage the first 43 and second 44 pair of spring actuated levers from outside the opening 26. In addition, the axially opposed ends 73A, 73B, 74A, 74B of the first 43 and second 44 lever pairs may be resiliently displaced along first and second linear travels paths when proximal ends of the first 43 and second 44 lever pairs are resiliently displaced along third and fourth linear paths respectively.

This operates such that the panel 28" preferably are caused to selectively pivot along the corresponding arcuate travel path 48 as desired by the user. It should be noted that although this embodiment of the apparatus 10" features a selectively pivoting panel 28", able to pivot toward either side 25 of the mattress 20, only one arcuate travel path 48 is shown. Also, the first and third linear travel paths may be situated at a first lateral end of the panels while the second and fourth travel paths may be situated at a second lateral end of the panels respectively so that the panels 28" are selectively articulated along either of the first and second lateral ends respectively.

Referring to FIGS. 1-6, the multi-purpose bed 10 may further include each of the pillows 27 being U-shaped. The shape of the pillow 27 advantageously fits the user's face to comfortably position the user's head to allow for alignment of the body and easier breathing during sleep. Each pillow 27 may also include a plurality of legs 50 pivotally connected to a bottom surface 51 thereof. Such legs 50 may be selectively biased between folded and unfolded positions and thereby elevate the bottom surface 51 of the pillows 27 away from the top 22 surface of the mattress 20 for providing user comfort. A user selectively positions the pillows 27 at a height appropriately set for their neck alignment and body position to prevent the twisting of the vertebrae that occurs when a person normally sleeps in the prone position. The legs 50 may also provide a protective barrier to air-borne fluids and debris expelled from another user occupying an adjacent pillow 27.

Referring to FIG. 2, each of the pillows 27 may further include a plurality of telescopically adjusted anchor pegs 52 removably nested within corresponding orifices 53 formed in the top 22 surface of the mattress 20. Such anchor pegs 52 may maintain the pillows 27 at a substantially stable position during extended time periods. This is necessary for preventing the user from inadvertently displacing the pillow 27 during restless sleep.

In use, a method for permitting a user to comfortably lay face-down during extended time periods may include the first step of providing a mattress 20 preferably having a linear passageway 21 formed between top 22 and bottom 23 surfaces thereof. The passageway 21 may extend towards a center 24 of the mattress 20 and may be disposed between opposed longitudinal sides 25 of the mattress 20 which is necessary so that ambient air is permitted to ingress and egress between the bottom 23 and top 22 surfaces of the mattress 20. The extension of the passageway's 21 across the mattress 20 allows for multiple openings 26 to permit air flow during placement of the bed against a wall if needed.

The mattress 20 further may have a plurality of openings 26 formed through the top 22 surface thereof to accommodate multiple users at the same time. Each of the openings 26 may be suitably sized and shaped for receiving a user face thereat while the user is laying face-down on the top 22 surface of the mattress.

In use, a second step of the method may include providing and removably attaching a plurality of pillows 27 to the top 22 surface of the mattress 20 by positioning the pillows 27 along partial perimeters of the openings 26 respectively. This operates such that the user face is supported adjacent to the openings 26 while the user is laying face-down on the mattress 20. A third step may include providing and adjustably situating a plurality of panels 28 beneath the openings 28 respectively. Fourthly, the method may include permitting and prohibiting free flow of the ambient air through a corresponding one of the openings 26 and the passageway 21 by independently adapting each of the panels 28 between open and closed positions respectively.

In use, a final step may include preventing air-borne fluids and debris from passing through the openings 26 and the passageway 21 by displacing each of the panels 28 along corresponding travel paths 72 extending subjacent to the openings 26 and defined between the top 22 and bottom 23 surfaces of the mattress 20 respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multi-purpose bed for permitting a user to comfortably lay face-down during extended time periods, said multi-purpose bed comprising:

a mattress having a linear passageway formed between top and bottom surfaces of said mattress, said passageway extending towards a center of said mattress and being disposed between opposed longitudinal sides of said mattress such that ambient air is permitted to ingress and egress between said bottom and top surfaces of said mattress, said mattress further having a plurality of openings formed through said top surface thereof, each of said openings being suitably sized and shaped for receiving a user face thereat while the user is laying face-down on said top surface of said mattress;

a plurality of pillows removably attached to said top surface of said mattress and positioned along partial perimeters of said openings respectively such that the user face is supported adjacent to said openings while the user is laying face-down on said mattress;

a plurality of panels adjustably situated beneath said openings respectively; and means for independently adapting each of said panels between open and closed positions for permitting and prohibiting free flow of the ambient air through a corresponding one of said openings and said passageway respectively;

wherein each of said panels are displaced along corresponding travel paths extending subjacent to said openings and defined between said top and bottom surfaces of said mattress respectively for preventing air-borne fluids and debris from passing through said openings and said passageway respectively.

2. The multi-purpose bed of claim 1, wherein said independent panel adapting means comprises:

a plurality of linear tracks formed along an interior wall of said mattress and spanning beneath said openings respectively, said linear tracks having a longitudinal length greater than a longitudinal length of said openings, said linear tracks outwardly extending away from a medial edge of said openings and terminating adjacent to said longitudinal sides of said mattress respectively;

wherein at least one portion of said panels is slidably interfitted within said linear tracks such that said panels remain disposed above said passageway and subjacent to said top surface of said mattress while being linearly displaced along said corresponding travel paths respectively;

wherein said corresponding travel paths are oriented parallel to a longitudinal length of said passageway as well as said top and bottom surfaces of said mattress respectively;

wherein said corresponding travel paths are mutually exclusive and non-overlapping.

3. The multi-purpose bed of claim 2, wherein said corresponding travel paths are linear and defined adjacent to said passageway such that said panels do not penetrate said passageway when displaced between said open and closed positions respectively.

4. The multi-purpose bed of claim 1, wherein said independent panel adapting means comprises:

a plurality of guide arms extending away from an interior wall of said mattress and spanning beneath said openings respectively, said guide arms being oriented along first and second linear rows facing opposite sides of said interior wall, said guide arms having a longitudinal length registered perpendicular to said longitudinal length of said passageway and maintaining a fixed spatial relationship from an adjacent one of said guide arms within said first and second rows respectively, selected ones of said spatial relationships being equal to a first linear distance and other ones of said spatial distances being equal to a second linear distance; and a plurality of wheels connected to opposed corners of said panels respectively, said wheels having a fixed diameter that is greater than said first linear distance and less than said second linear distance respectively;

wherein said corresponding travel paths of said panels are arcuate and defined about oppositely situated fulcrum pivot axes defined at opposed ends of said panels respectively, said fulcrum pivot axes being oriented perpendicular to said longitudinal length of said passageway respectively, each of said fulcrum pivot axes being substantially aligned with said corresponding edges of said openings respectively such that said panels pivot downward and upward within said passageway respectively.

5. The multi-purpose bed of claim 4, wherein first and second ones of said wheels are respectively supported on top of a first pair of said guide arms at said first row and a second pair of said guide arms at said second row respectively, said first and second guide arm pairs maintaining said first linear distance therebetween respectively;

wherein third and fourth ones of said wheels are respectively passed between a third pair of said guide arms at said first row and a fourth pair of said guide arms at said second row respectively, said third and fourth pairs of said guide arms maintaining said second linear distance therebetween respectively.

6. The multi-purpose bed of claim 5, wherein each of said panels is selectively pivoted about first and second arcuate paths and thereby independently articulated between a horizontally rested position and a vertically rested position traversing said longitudinal length of said passageway respectively.

7. The multi-purpose bed of claim 6, wherein said passageway is partitioned when at least one of said panels is pivoted to said vertically rested position respectively.

8. The multi-purpose bed of claim 1, wherein said independent panel adapting means comprises:

first and second linear channels formed along oppositely facing medial and lateral ends of said panels respectively;

a plurality of juxtaposed notches formed within said inner wall of said mattress and situated subjacent to said openings respectively;

a first pair of spring-actuated levers passing through said first linear channel in such a manner that axially opposed ends of said first pair of levers are removably interfitted into corresponding ones of said notches respectively;

a second pair of spring-actuated levers passing through said second linear channel in such a manner that axially opposed ends of said second pair of levers are removably interfitted into corresponding ones of said notches respectively;

first and second access ports formed at top surfaces of said panels respectively;

wherein said axially opposed ends of said first and second lever pairs are resiliently displaced along first and second linear travels paths when proximal ends of said first and second lever pairs are resiliently displaced along third and fourth linear paths respectively such that said panels are caused to selectively pivot along said corresponding travel paths as desired by the user;

wherein said first and third linear travel paths are situated at a first lateral end of said panels while said second and fourth travel paths are situated at a second lateral end of said panels respectively so that said panels are selectively articulated along either of said first and second lateral ends respectively.

9. The multi-purpose bed of claim 1, wherein each of said pillows are U-shaped and comprises: a plurality of legs pivotally connected to a bottom surface thereof, said legs being selectively biased between folded and unfolded positions and thereby elevating said bottom surface of said pillows away from said top surface of said mattress for providing user comfort.

10. The multi-purpose bed of claim 1, wherein each of said pillows further comprises: a plurality of telescopically adjusted anchor pegs removably nested within corresponding orifices formed in said top surface of said mattress for maintaining said pillows at a substantially stable position during extended time periods.

11. A multi-purpose bed for permitting a user to comfortably lay face-down during extended time periods, said multi-purpose bed comprising:

a mattress having a linear passageway formed between top and bottom surfaces of said mattress, said passageway extending towards a center of said mattress and being disposed between opposed longitudinal sides of said mattress such that ambient air is permitted to ingress and egress between said bottom and top surfaces of said mattress, said mattress further having a plurality of openings formed through said top surface thereof, each of said openings being suitably sized and shaped for receiving a user face thereat while the user is laying face-down on said top surface of said mattress;

a plurality of pillows removably attached to said top surface of said mattress and positioned along partial perimeters of said openings respectively such that the user face is supported adjacent to said openings while the user is laying face-down on said mattress;

a plurality of panels adjustably situated beneath said openings respectively; and means for independently adapting each of said panels between open and closed positions for permitting and prohibiting free flow of the ambient air through a corresponding one of said openings and said passageway respectively;

wherein each of said panels are displaced along corresponding travel paths extending subjacent to said openings and defined between said top and bottom surfaces of said mattress respectively for preventing air-borne fluids and debris from passing through said openings and said passageway respectively.

12. The multi-purpose bed of claim 11, wherein said independent panel adapting means comprises:

a plurality of linear tracks formed along an interior wall of said mattress and spanning beneath said openings respectively, said linear tracks having a longitudinal length greater than a longitudinal length of said openings, said linear tracks outwardly extending away from a medial edge of said openings and terminating adjacent to said longitudinal sides of said mattress respectively;

wherein at least one portion of said panels is slidably interfitted within said linear tracks such that said panels remain disposed above said passageway and subjacent to said top surface of said mattress while being linearly displaced along said corresponding travel paths respectively;

wherein said corresponding travel paths are oriented parallel to a longitudinal length of said passageway as well as said top and bottom surfaces of said mattress respectively;

wherein said corresponding travel paths are mutually exclusive and non-overlapping.

13. The multi-purpose bed of claim 12, wherein said corresponding travel paths are linear and defined adjacent to said passageway such that said panels do not penetrate said passageway when displaced between said open and closed positions respectively.

14. The multi-purpose bed of claim 11, wherein said independent panel adapting means comprises:

a plurality of guide arms extending away from an interior wall of said mattress and spanning beneath said openings respectively, said guide arms being oriented along first and second linear rows facing opposite sides of said interior wall, said guide arms having a longitudinal length registered perpendicular to said longitudinal length of said passageway and maintaining a fixed spatial relationship from an adjacent one of said guide arms within said first and second rows respectively, selected ones of said spatial relationships being equal to a first linear distance and other ones of said spatial distances being equal to a second linear distance; and a plurality of wheels connected to opposed corners of said panels respectively, said wheels having a fixed diameter that is greater than said first linear distance and less than said second linear distance respectively;

wherein said corresponding travel paths of said panels are arcuate and defined about oppositely situated fulcrum pivot axes defined at opposed ends of said panels respectively, said fulcrum pivot axes being oriented perpendicular to said longitudinal length of said passageway respectively, each of said fulcrum pivot axes being substantially aligned with said corresponding edges of said openings respectively such that said panels pivot downward and upward within said passageway respectively.

15. The multi-purpose bed of claim 14, wherein first and second ones of said wheels are respectively supported on top of a first pair of said guide arms at said first row and a second pair of said guide arms at said second row respectively, said first and second guide arm pairs maintaining said first linear distance therebetween respectively;

wherein third and fourth ones of said wheels are respectively passed between a third pair of said guide arms at said first row and a fourth pair of said guide arms at said second row respectively, said third and fourth pairs of said guide arms maintaining said second linear distance therebetween respectively.

16. The multi-purpose bed of claim 15, wherein each of said panels is selectively pivoted about first and second arcuate paths and thereby independently articulated between a horizontally rested position and a vertically rested position traversing said longitudinal length of said passageway respectively.

17. The multi-purpose bed of claim 16, wherein said passageway is partitioned when at least one of said panels is pivoted to said vertically rested position respectively.

18. The multi-purpose bed of claim 11, wherein said independent panel adapting means comprises:

first and second linear channels formed along oppositely facing medial and lateral ends of said panels respectively;

a plurality of juxtaposed notches formed within said inner wall of said mattress and situated subjacent to said openings respectively;

a first pair of spring-actuated levers passing through said first linear channel in such a manner that axially opposed ends of said first pair of levers are removably interfitted into corresponding ones of said notches respectively;

a second pair of spring-actuated levers passing through said second linear channel in such a manner that axially opposed ends of said second pair of levers are removably interfitted into corresponding ones of said notches respectively;

first and second access ports formed at top surfaces of said panels respectively;

wherein said axially opposed ends of said first and second lever pairs are resiliently displaced along first and second linear travels paths when proximal ends of said first and second lever pairs are resiliently displaced along third and fourth linear paths respectively such that said panels are caused to selectively pivot along said corresponding travel paths as desired by the user;

wherein said first and third linear travel paths are situated at a first lateral end of said panels while said second and fourth travel paths are situated at a second lateral end of said panels respectively so that said panels are selectively articulated along either of said first and second lateral ends respectively.

19. The multi-purpose bed of claim 11, wherein each of said pillows are U-shaped and comprises: a plurality of legs pivotally connected to a bottom surface thereof, said legs being selectively biased between folded and unfolded positions and thereby elevating said bottom surface of said pillows away from said top surface of said mattress for providing user comfort.

20. A method for permitting a user to comfortably lay face-down during extended time periods, said method comprising the chronological steps of:

a. providing a mattress having a linear passageway formed between top and bottom surfaces of said mattress, said passageway extending towards a center of said mattress and being disposed between opposed longitudinal sides of said mattress such that ambient air is permitted to ingress and egress between said bottom and top surfaces of said mattress, said mattress further having a plurality of openings formed through said top surface thereof, each of said openings being suitably sized and shaped for receiving a user face thereat while the user is laying face-down on said top surface of said mattress;

b. providing and removably attaching a plurality of pillows to said top surface of said mattress by positioning said pillows along partial perimeters of said openings respectively such that the user face is supported adjacent to said openings while the user is laying face-down on said mattress;

c. providing and adjustably situating a plurality of panels beneath said openings respectively;

d. permitting and prohibiting free flow of the ambient air through a corresponding one of said openings and said passageway by independently adapting each of said panels between open and closed positions respectively; and e. preventing air-borne fluids and debris from passing through said openings and said passageway by displacing each of said panels along corresponding travel paths extending subjacent to said openings and defined between said top and bottom surfaces of said mattress respectively.

* * * * *